United States Patent [19]

Hedrick

[11] Patent Number: 4,514,128

[45] Date of Patent: Apr. 30, 1985

[54] SIGNATURE STACKER INCLUDING IMPROVED INTERCEPT MEANS

[75] Inventor: Robert Hedrick, Elm Grove, Wis.

[73] Assignee: Mailroom Systems, Inc., Germantown, Wis.

[21] Appl. No.: 397,103

[22] Filed: Jul. 12, 1982

[51] Int. Cl.[3] ..... B65H 31/30; B65H 31/32

[52] U.S. Cl. ..... 414/49; 91/36; 92/68; 92/69 B; 271/189; 271/218; 414/50; 414/901

[58] Field of Search ..... 271/189, 217, 218, 219; 414/48, 49, 50, 901; 74/128, 129; 91/36; 92/68, 69 B

[56] References Cited

U.S. PATENT DOCUMENTS

| | | | |
|---|---|---|---|
| Re. 25,018 | 8/1961 | Howdle et al. | 93/93 |
| 3,156,464 | 11/1964 | Piškytl et al. | 271/189 |
| 3,362,707 | 1/1968 | Lauren | 271/88 |
| 3,379,320 | 4/1968 | Loach et al. | 214/6.5 |
| 3,429,239 | 2/1969 | Murchison et al. | 414/45 |
| 3,548,995 | 12/1970 | Oderman et al. | 198/20 |
| 3,566,757 | 3/1971 | Fujiuhiro | 93/93 |
| 3,568,815 | 3/1971 | Wiseman | 198/23 |
| 3,599,807 | 8/1971 | Hedrick | 214/6.5 |
| 3,831,781 | 8/1974 | Anikanov et al. | 214/6 BA |
| 3,861,537 | 1/1975 | Duchinsky et al. | 214/6 BA |
| 3,902,609 | 9/1975 | Ohlsson | 214/6 P |
| 3,908,985 | 9/1975 | Wiseman | 271/189 |
| 4,017,110 | 4/1977 | Pease et al. | 91/217 |
| 4,037,525 | 7/1977 | Sjogren et al. | 93/93 C |
| 4,103,785 | 8/1978 | Wiseman | 214/6.5 |
| 4,139,191 | 2/1979 | Muller | 271/189 |
| 4,183,704 | 1/1980 | Steinhart | 214/6.5 |

*Primary Examiner*—Bruce H. Stoner, Jr.
*Assistant Examiner*—John A. Carroll

[57] ABSTRACT

A signature stacker providing improved structure for intercepting a stream of signatures of newspapers from a infeed conveyor of a press apparatus and having improved apparatus for controlling timed operation of the various elements of the stacker so as to provide for high speed and continuous operation of the stacker.

23 Claims, 5 Drawing Figures

SIGNATURE STACKER INCLUDING IMPROVED INTERCEPT MEANS

FIELD OF THE INVENTION

The present invention relates to signature stackers and more particularly to a novel stacker for forming bundles of newspapers or other similar signatures delivered to the stacker in a continuous stream, the stacker including improved means for controlling the operation of the stacker such that the stacker can operate reliably at high speeds.

BACKGROUND PRIOR ART

Stackers are commonly used in the newspaper and magazine industry wherein it is desired to handle the signatures comprised of magazines and folded newspapers and to form uniform bundles of a predetermined number of signatures. Signatures are typically delivered to the stacker in a continuous stream and are arranged in overlapping fashion. The delivery rate of signatures such as newspapers delivered from the press room can be at rates which produce a 12" bundle every second. Accordingly, it is necessary to provide a stacker which is capable of handling such a high speed continuous stream of signatures and forming accurate sized bundles at the rate of approximately one every second for extended periods of time and without failure. A breakdown of the stacker or jamming of the signatures in the stacker can result in shutdown of the entire printing system.

Conventional stackers are typically comprised of an infeed conveyor system which receives the continuous stream of signatures and which, in turn, is provided with means for counting the signatures as they pass through the infeed system. The signatures fall from the infeed system onto a stack support mechanism to thereby form bundles. When a suitable bundle is formed, the bundle is conveyed or dropped onto an outfeed conveyor. Means are further provided for periodically intercepting the stream of signatures at a location intermediate the infeed and the stack support mechanism while the bundles are conveyed from the stack support mechanism to the outfeed conveyor. The intercepting means forms a small bundle of signatures, and then deposits these signatures on the stack support mechanism once it has returned to an operable position.

Examples of prior art stackers are illustrated in the Sjogren et al. U.S. Pat. No. 4,037,525, issued July 26, 1977; the Wiseman U.S. Pat. No. 4,103,785, issued Aug. 1, 1978; the Wiseman U.S. Pat. No. 3,568,815, issud Mar. 9, 1971; and the Howdle et al. U.S. Pat. No. Re. 25,081, issued Aug. 8, 1961.

Attention is also directed the the Oderman U.S. Pat. No. 3,548,995, issued Dec. 22, 1970; the Loach et al. U.S. Pat. No. 3,379,320, issued Apr. 23, 1968; the Fujishiro U.S. Pat. No. 3,566,757, issued Mar. 2, 1971; and the Hedrick U.S. Pat. No. 3,599,807, issued Aug. 17, 1971.

Other prior art stacking devices are illustrated in the Anikanov et al. U.S. Pat. No. 3,831,781, Aug. 27, 1974; the Duchinsky et al. U.S. Pat. No. 3,861,537, issued Jan. 21, 1975; the Ohlsson U.S. Pat. No. 3,902,609, issued Sept. 2, 1975.

Attention is further directed to the Muller U.S. Pat. No. 4,139,191, issued Feb. 13, 1979; the Steinhart U.S. Pat. No. 4,183,704, issued Jan. 15, 1980; the Murchison et al. U.S. Pat. No. 3,429,239, issued Feb. 25, 1969; and the Lauren U.S. Pat. No. 3,362,707, issued Jan. 9, 1968.

SUMMARY OF THE INVENTION

The invention includes a signature stacker providing improved means for intercepting the stream of signatures or newspapers from the infeed conveyor of a press apparatus and improved means for controlling timed operation of the various elements of the apparatus so as to provide for high speed and continuous operation of the stacker. The improved means for intercepting and the improved control means provide for operation of the stacker at sufficiently high speeds that it can receive and stack bundles of signatures from high speed presses running at maximum output and continue to operate reliably for extended periods of time at such high speeds. The stacker of the invention also provides simplified structure which can be readily manufactured and which has greater durability and reliability in operation than the prior art devices.

More particularly, the invention includes a signature stacker for forming bundles containing a preselected number of signatures from an incoming stream of signatures delivered to the stacker. The signature stacker includes a stacking blade assembly positioned below an infeed conveyor means and for receiving a preselected number of signatures from the infeed conveyor means and for forming a bundle of signatures, the stacking blade being moveable between a stacking position wherein the stacking blade assembly can receive signatures and a retracted position wherein this bundle is dropped onto a bundle outfeed means. The signature stacker also includes an interceptor blade assembly positioned between the infeed conveyor means and the stacking blade assembly, the interceptor blade assembly including a first blade assembly and a second blade assembly, each blade assembly including at least one interceptor blade. The interceptor blade assembly also includes means for supporting the blade assemblies for selective rotational indexing movement around a horizontal axis and with one of the blade assemblies being supported on one side of the horizontal axis in a first position and the other of the blade assemblies being supported on an opposite side of the horizontal axis in a retracted position.

The invention also includes a signature stacker for forming bundles containing a selected number of signatures from an incoming stream of signatures delivered to the signature stacker, the signature stacker including a stacking blade assembly positioned below an infeed conveyor means and for receiving a selected number of signatures from this infeed conveyor means and for forming a bundle of signatures. The stacking blade assembly includes at least one stacking blade adapted to support a bundle of signatures, and means for supporting the stacking blade for movement from a first position wherein the stacking blade is positioned over a bundle outfeed means, and wherein the stacking blade supports signatures thereon, and a retracted position wherein the stacking blade drops the bundle onto the bundle outfeed means. The signature stacker also includes means for interrupting the stream of signatures when the stacking blade is moved to the retracted position, the means for intercepting including an interceptor blade selectively moveable from a first position to an intercept position wherein the interceptor blade moves into the path of the stream of signatures so as to support a stack of signatures. The interceptor blade is also moveable to a retracted position wherein the inteceptor will drop the signatures supported thereon onto the stacking blade. Means are also provided for counting a preselected number of signatures passing through the infeed conveyor means and for causing the stacking blades to move from the stacking position to the retracted position and the interceptor blade to move from the first position to the intercept position. The signature stacker also includes means for causing the stacking blade to return to the stacking position when the stacking blade reaches the retracted position, and means for causing the interceptor blades to move to the retracted position when the stacking blade approaches the stacking position but before the stacking blade reaches the stacking position.

The invention also includes means for causing indexing rotation of a shaft about its longitudinal axis from a first rotational position to a second rotational position and then to the first rotational position. The means for causing indexing rotation comprises a lever arm having opposite ends, one end being fixed to an end of the central shaft, and a fluid cylinder assembly including a first fluid cylinder and a second fluid cylinder fixed together in a linear aligned relation. The fluid cylinder assembly has opposite ends, one of the opposite ends being pivotably supported by the machine frame and the other of the opposite ends being connected to the other of opposite ends of the lever arm.

In one preferred embodiment of the invention the means for supporting the first and second interceptor blade assemblies includes a central shaft rotatable about the horizontal axis, a first support means fixed to a central shaft for rotation about the horizontal axis and for supporting the first interceptor blade for selective rotation about an axis parallel to the central axis and spaced outwardly from the central axis. A second support means is also fixed to the central shaft for rotation about the horizontal axis and for supporting the second interceptor blade for selective rotation about a second axis parallel to the central axis and spaced outwardly from the central axis, the axis of the second support means being on an opposite side of the central axis from the axis of the first support means.

In a preferred embodiment of the invention the means for supporting the interceptor blade assemblies includes a cam track surrounding the central axis, and the first support means includes a first support shaft and a lever having one end fixed to the first support shaft and the other end connected to a cam follower adapted to move along the cam track in response to rotational indexing movement of the first and second interceptor blade assemblies around the central axis.

In a preferred embodiment of the invention the interceptor blade assembly includes a central shaft having opposite ends and supporting the first interceptor blade assembly and the second interceptor blade assembly, and means for causing indexing rotation of the central shaft about its axis. The means for causing indexing rotation includes a lever arm having one end fixed to one end of the central shaft, and a fluid cylinder assembly including a first fluid cylinder and a second fluid cylinder fixed together in a linearly aligned relation, the fluid cylinder assembly having opposite ends, one of the opposite ends being connected to the stacker frame and the other of the opposite ends being connected to the other end of the lever arm.

In a preferred embodiment of the invention the first fluid cylinder includes a first cylinder and a first extensible piston, and the second fluid cylinder includes a second cylinder and a second extensible piston, the first cylinder and the second cylinder being fixedly joined together in end-to-end abutting relating, and the pistons being extensible in opposite directions.

In another preferred embodiment of the invention means are further provided for controlling extension and retraction of the pistons to thereby cause indexing of the central shaft from a first rotational position to a second rotational position, the intercept blade being in a first index position when a first one of the pistons is extended and the second piston is retracted. The means for causing the central shaft to rotate from the first index position to the second index position includes means for causing extension of the second piston and then retraction of the second piston, and the means for causing the central shaft to rotate from the second index position to the first index position includes means for causing retraction of the first piston and then extension of the first piston.

Various other features and advantages of the invention will be apparent by reference to the following description of a preferred embodiment, from the drawings, and from the claims.

Figure 1:
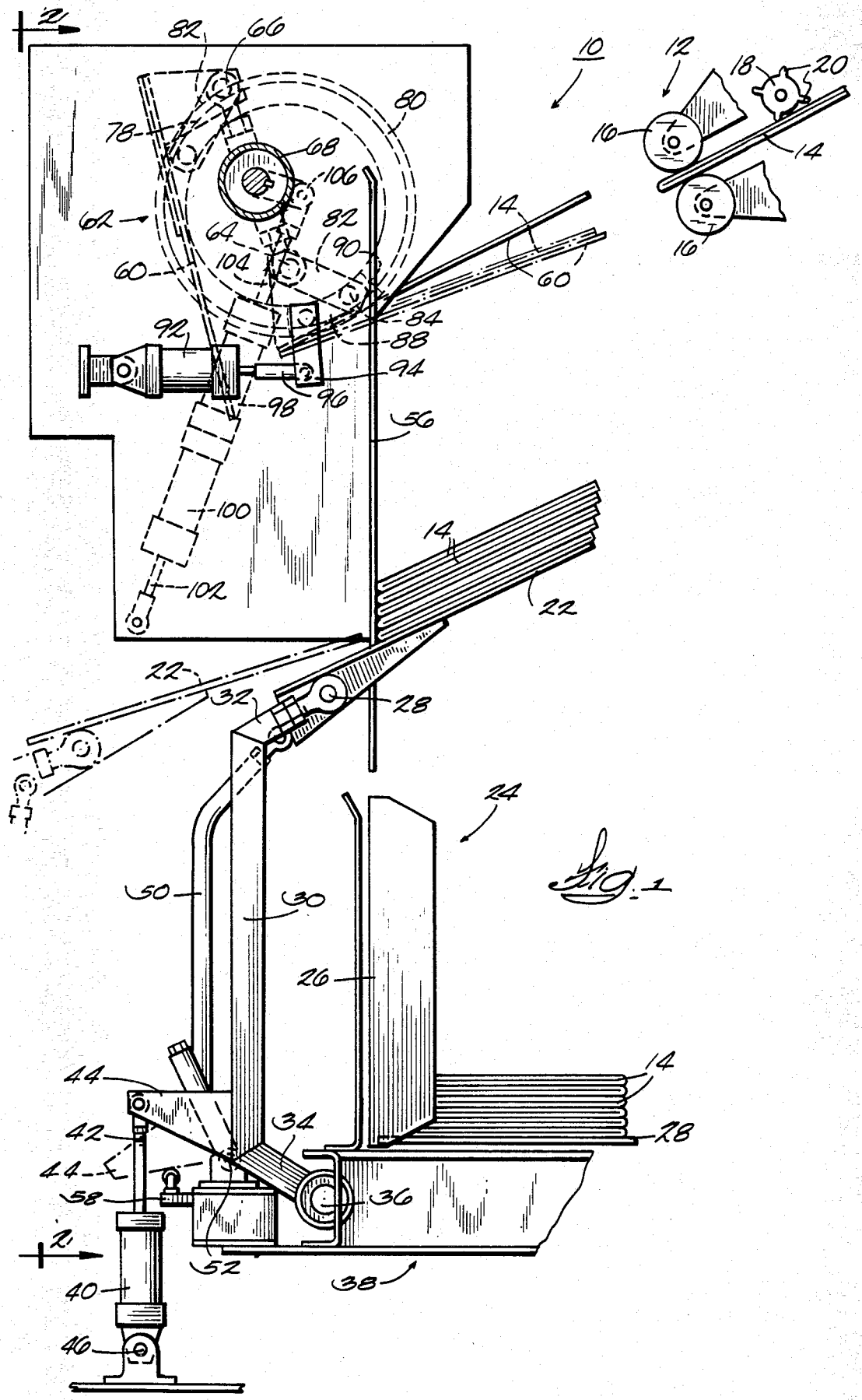
FIG. 1 is a partial side elevation view of a newspaper stacker embodying the invention.

Before describing various embodiments of the invention in detail, it is to be understood that the invention is not limited in its application to the details of construction and to the arrangements set forth in the following description or illustrated in the drawings. The invention is capable of further embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a stacker 10 embodying the present invention and including an infeed section 12 adapted to receive a stream of signatures 14 from the downstream end of a signature conveyor (not shown). For purposes of example, the conveyor may be employed to deliver a continuous stream of newspapers 14 from a press to the stacker, the papers being folded and arranged on the conveyor with the fold facing the direction of movement of the stream. While the infeed section 12 could have various constructions, in the illustrated arrangement it includes a pair of driven rollers 16 adapted to be positioned above and below the signatures 14 being fed by the signature conveyor. The rollers 16 grip the signatures 14 therebetween and are rotationally driven so as to propel the successive signatures 14 downwardly and to the left, as seen in FIG. 1, into the signature stacker 10.

The signature stream is intended to move through the infeed section 12 of the stacker 10, and means are provided in the infeed section for counting the signatures as they pass through the infeed section, the counting means including means for sensing each signature and for generating a signal when a predetermined number of signatures 14 have passed through the infeed section. While the counting means could include any conventional signature sensing mechanical or light emitting counting means, in one embodiment of the invention the counting means can include a rotatable wheel 18 having outwardly extending arms 20. In the illustrated construction the wheel 18 is positioned above the stream of signatures 14 and such that, as the signatures move through the infeed section 12, the fold line of each signature passing through the infeed conveyor will contact one of the arms 20 causing rotational indexing of the wheel 18. The counting means also includes means for counting each indexing movement of the wheel and means for emitting a signal when the counting wheel 18 indexes a preselected number of times.

Means are also provided for receiving a signature 14 from the infeed section 12 and for forming a stack or bundle of signatures. This means is illustrated as comprising a pair of stacking blades 22 positioned below the infeed section and such that, as the signatures 14 move through the infeed section 12, they will pile up on the stacking blades 22 to form a bundle. The stacking blades 22 are intended to deposit the completed bundle into a holding bucket assembly 24. In the illustrated arrangement the holding bucket assembly 24 has upright sidewalls 26 for holding and neatly stacking the signatures deposited from the stacking blades. The holding bucket assembly is also mounted on a turntable 20, and can be caused to rotate 180° when desired and to form compensated bundles, the first group of the signatures stacked thereon having a fold on one side of the holding bucket assembly 24 and with the other portion of the signatures being stacked with folds on an opposite side of the holding bucket assembly 24. The holding bucket assembly 24 and the apparatus associated therewith for causing selected indexing or rotation of the holding bucket assembly comprise conventional apparatus employed in other prior art stackers and will not be described in detail.

To facilitate the depositing of stacked bundles from the stacking blades 22 and for dropping the stacked bundles into the holding bucket assembly 24, means are provided for causing the stacking blades 22 to be retracted, i.e. to be moved downwardly and rearwardly from the position shown in solid lines in FIG. 1 to the position shown in phantom in response to a signal from the counting means. When the blades 22 are moved downwardly and rearwardly, the stacked bundle thereon is then allowed to fall into the holding bucket assembly 24 for transfer to an outfeed conveyor. The apparatus for transferring the stacked bundles to the outfeed conveyor is conventional and will not be described in detail.

Referring now to the stacking blade assembly, in the illustrated arrangement, it is comprised of a pair of stacking blades 22 positioned in side-by-side, spaced apart relation (FIG. 2), the stacking blades 22 being positioned beneath the infeed section 12 and being adapted to catch the newspapers or signatures as they are emitted by the infeed section and dropped toward the holding bucket assembly 24.

The stacking blades 22 are fixedly joined to a horizontal shaft 28 and the means for causing retraction of the stacking blades 22 to thereby permit the bundles to be dropped into the holding bucket assembly 24 includes a pair of generally vertical arms 30 pivotally connected at their upper ends 32 to the opposite ends of the horizontal shaft 28 fixedly supporting the stacking blades. The lower ends 34 of the vertical arms 30 are pivotally joined at 36 to the machine frame 38 so as to be supported for pivotal movement about an axis parallel to the axis of the horizontal shaft 28.

Means are also provided for causing retraction of the stacking blades 22 in response to a signal from the counting means. This means for causing retraction of the stacking blades 22 includes a pneumatic cylinder 40 having a piston rod 42 with the free end thereof being operably connected to one of the vertical arms 30. In the illustrated embodiment, a lever arm 44 is fixedly connected to a lower portion of one of the vertical arms 30 adjacent the lower end 34, this lever arm 44 projecting rearwardly from the vertical arm 30. The pneumatic cylinder 40 is pivotally supported at its lower end by a pin 46 and the upper end of the piston rod 42 of the pneumatic cylinder is pivotally connected to the rearwardly projecting or free end of the lever arm. While the fluid motor 40 and other fluid motors to be described hereinafter comprise pneumatic cylinders, it will be understood that in other arrangements they could comprise hydraulic cylinders or other linear actuators. Valve means are also provided for controlling the flow of air into the pneumatic cylinder 40 to thereby cause extension and retraction of the piston and consequent pivotal movement of the vertical arms supporting the stacking blades.

The means for supporting the stacking blades 22 for reciprocal movement also includes a lever arm 48 (FIG. 2) fixed to the horizontal shaft 28 supporting the stacking blades 22. The lever arm 48 extends generally rearwardly, and a generally vertical bar 50 is pivotally connected at its upper end to the free end of the rearwardly extending lever arm 48. The lower end of the generally vertical bar 50 is pivotally connected by a pin 52 to the machine frame at a point rearwardly of the pivot means 36 of the vertical arms 30.

It will be appreciated that downward movement of the piston rod 42 will cause a rearward pivotal movement of the arms 30 and 50 supporting the stacking blades 22 and thereby causing generally linear movement of the stacking blades 22 downwardly and away from the position where the stacking blades support a bundle of signatures. The bundle of signatures 14 is prevented from such rearward movement with the stacking blades by a plurality of fixed vertical bars 56 which comprise portions of the machine frame 38.

In a preferred form of the invention, the valve means for use in controlling air flow to the pneumatic cylinder 40 comprises a one pulse valve operably connected to the means for counting the signatures fed through the infeed conveyor. Also included is a limit switch 58 connected to the one pulse valve and causing the one pulse valve to reverse the movement of the piston 42 of the pneumatic cylinder 40 so as to cause return movement of the stacker blades 22 to the extended position. More particularly, when the counting means counts a sufficient number of signatures having passed through the infeed section 12 the counting means emits a signal via a timer to the one pulse valve associated with cylinder 40, causing that valve to effect downward retraction of the piston rod 42 of the pneumatic cylinder 40 and consequent retraction of the stacker blades 22. As the stacker blades 22 reach their retracted position, one of the lever arms 44 engages the limit switch 58 and a signal is transmitted to cylinder 40 to effect extention of the piston rod 42 and a return of the stacker blades 22 to their original position for receiving another stack of signatures from the infeed section 12 and for forming another bundle of signatures.

Means are also provided for interrupting the flow of signatures 14 from the infeed section 12 during the time that the stacking blades 22 are retracted. This means for interrupting includes intercept or interceptor blades 60 which are located above the stacking blades 22 and which are functional to move into the stream of signatures 14 at the time the stacking blades 22 begin to be retracted to support the signatures 14 until such time as the stacking blades 22 return to their original position, whereupon, the interceptor blades 60 are retracted so as to drop the signatures 14 thereon onto the stacking blades 22.

As previously stated, it is preferred that the stacker operate at speeds sufficient that a bundle of signatures can be formed on the stacking blades 22 and be dropped into the holding bucket assembly 24 in one second. Accordingly, it is necessary to provide means for rapidly moving the interceptor blades 60 into the intercept position and for then rapidly moving the intercept blades to a retracted position. To facilitate this rapid movement of the intercept blades 60, in the illustrated arrangement the intercept blade assembly 62 includes two pairs of intercept blades 60 supported for selective and alternative movement into a position where they intercept the stream of signatures 14 moving from the infeed section 12 to the stacking blades 22.

In the illustrated arrangement, a first pair of intercept blades 60 are supported on a first horizontal supporting shaft 64. A second pair of intercept blades 60 are supported on a second horizontal supporting shaft 66. The first and second supporting shafts 64 and 66 are supported in a spaced apart relation and on opposite sides of the central longitudinal axis of a horizontal central driven shaft 68. The opposite ends of the central shaft 68 are supported by bearings 70 (FIG. 2), in turn supported by the machine frame 38, and the central shaft 68 is supported by the bearings 70 so as to be freely rotatable about its longitudinal axis. The first support shaft 64 is connected to the central shaft by a pair of arms 72 fixedly joined to the central shaft 68 and extending outwardly from the central shaft. The first shaft 64 is supported by the arms 72 such that it is permitted rotation about its longitudinal axis. Similarly, a pair of arms 74 support the opposite ends of the second shaft 66 and support the second shaft in radially outwardly spaced relation from the axis of rotation of the central shaft 68 and such that the second shaft 66 is permitted rotation about its longitudinal axis.

Referring more particularly to the means for securing the intercept blades 60 to the first and second support shafts 64 and 66, respectively, the intercept blades 60 are fixed by brackets 78 to the support shafts.

Figure 2:
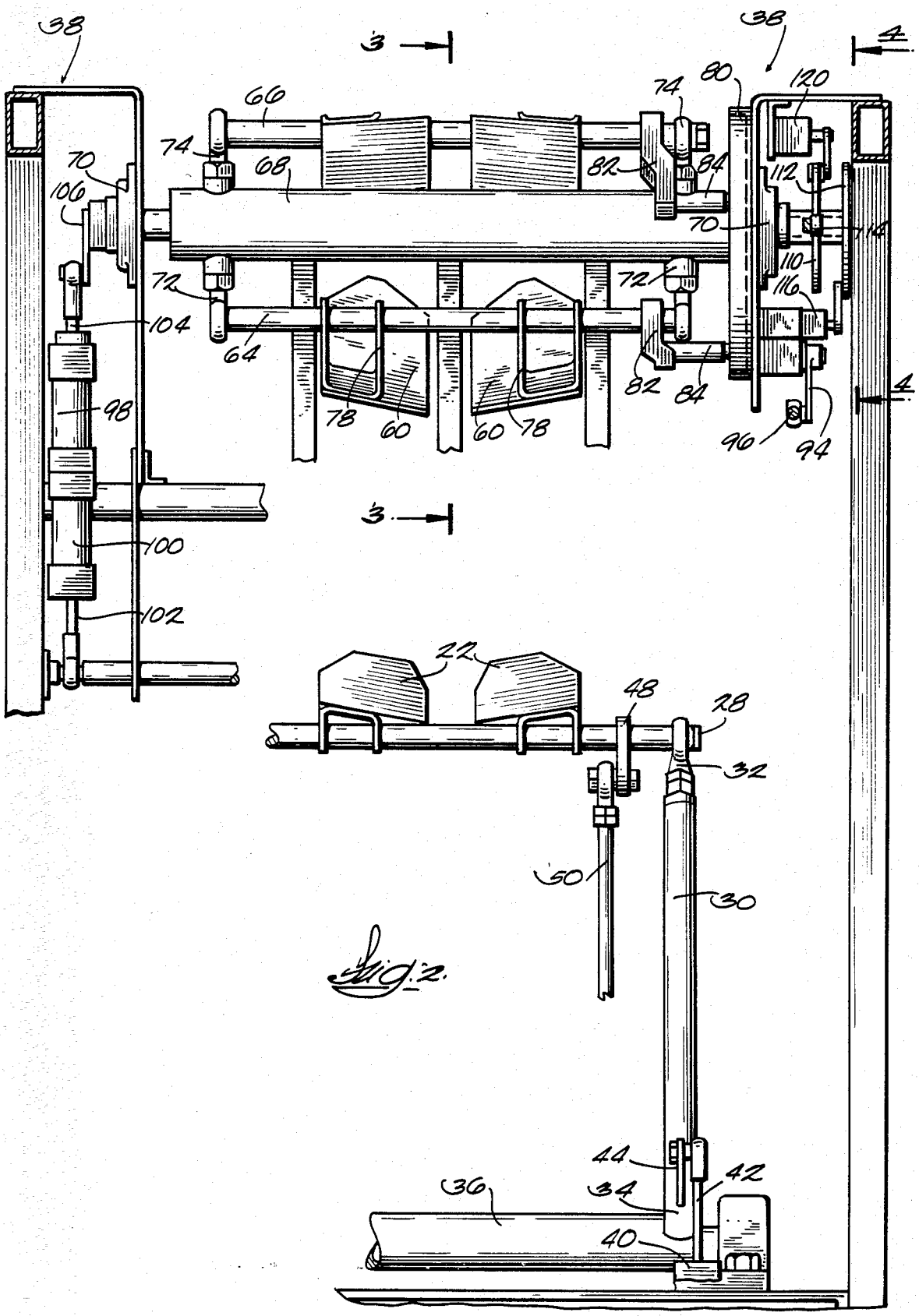
FIG. 2 is a view taken along line 2—2 in FIG. 1.
Figure 3:
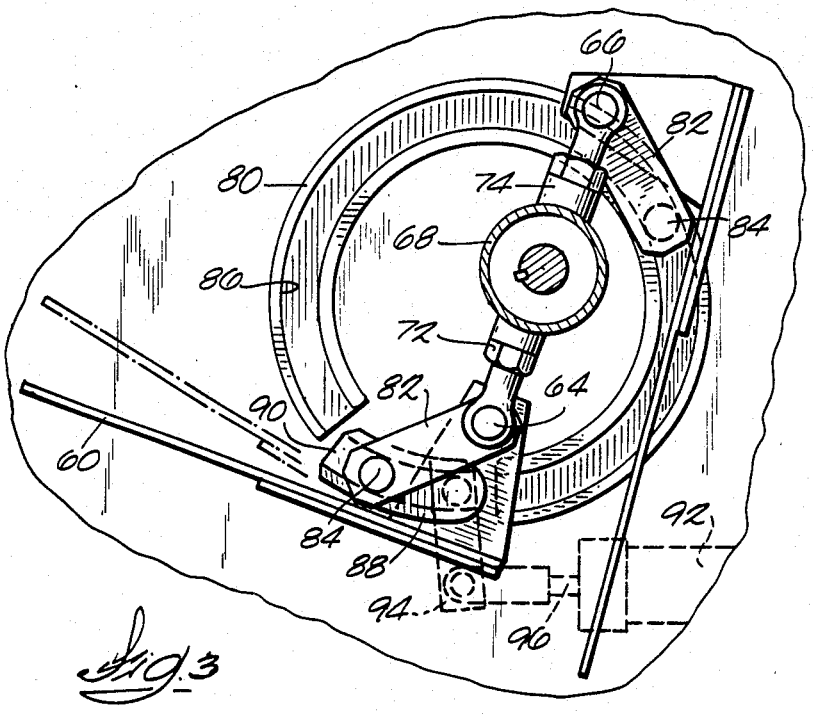
FIG. 3 is a cross section view taken along line 3—3 in FIG. 2.

The interceptor blade assembly also includes means for controlling the relative position of the interceptor blades 60 during rotation of the central shaft 68. This means includes a generally circular cam track 80 (best shown in FIG. 3) fixed to the machine frame 38 and surrounding one end of the central shaft 68. As best illustrated in FIGS. 2 and 3, an arm 82 is fixed to each of the first and second support shafts 64 and 66, respectively. The free ends of the arms 82, in turn, support cam followers 84 adapted to be housed in a generally circular groove or cam track 86 in the face of the cam 80 facing the interceptor blades 60 and their supporting structure. As shown in FIG. 3, the cam 80 and the cam surface defined by the circular groove 86 surround one end of the central shaft 68 but are positioned eccentrically with respect to its axis of rotation. In operation of the interceptor blades 60, and as as will be described in greater detail hereinafter, following each signature stacking cycle and wherein the intercept or blades 60 intercept the stream of signatures 14 and form a stack of signatures which is then dropped onto the stacking blades 22, as the stacking blades 22 return to a stacking position, the central shaft 68 will be caused to rotate about its longitudinal axis, thereby causing indexing movement of the intercept blades 60 about the axis of the central shaft 68. During such indexing movement, the cam followers 84 move through an arc of 180 degrees in the cam track 86 and control the relative movement of the interceptor blades 60 around the axis of their respective supporting shafts 64 and 66. Means are also provided for causing selective pivotal movement of the interceptor blades 60 about the axes of the respective supporting horizontal shafts 64 and 66 from a position wherein the interceptor blades 60 are in a ready position above the stacking blades 22, as shown in solid lines in FIG. 1, and an intercept position wherein the tips of the interceptor blades 60 drop below the path of the signatures such that the signatures are then collected on the interceptor blades 60. In the illustrated construction the cam 80 includes a portion thereof 88 which is supported for pivotal movement about an axis parallel to the axis of the central shaft 68 and such that a forward end 90 of that cam portion is moveable downwardly. When the interceptor blades 60 are positioned in the solid line position shown in FIGS. 1 and 3, the cam follower 84 connected to those interceptor blades 60 is housed in the portion of the cam 80 formed by the forward end 90 of the moveable cam portion 88. Downward movement of this forward end 90 causes pivotal movement of the support shaft 64 about its longitudinal axis and consequent downward movement of the tips of the interceptor blades 60.

Means are also provided for selectively causing such movement of the cam track portion 88 from the first position to the second or intercept position. In the illustrated construction, this means for causing movement of the moveable cam track portion 88 includes a pneumatic cylinder 92 having one end fixed to the machine frame and a piston 96 connected to the lower end of a lever arm 94. The lever arm 94 is pivoted about the pivot axis of the moveable portion 88 of the cam track 80 and fixed thereto such that extension and retraction of the piston 96 of the pneumatic cylinder 92 results in pivotal movement of the moveable portion 88 of the cam track.

A double coil one pulse valve is operably connected to this pneumatic cylinder 92 to control its operation. The valve is in turn connected to the signature counting means. The signature counting means is adapted to generate a signal to the one pulse valve and to thereby cause extension of the piston 96 of the pneumatic cylinder 92 and causing the moveable portion 88 of the cam track 80 to pivot downardly. Such movement of the moveable portion 88 of the cam causes the interceptor blades 60 to move to the intercept position.

Means are also provided for causing control of rotation or indexing of the central shaft 68 supporting the interceptor blades 60 and for causing indexing of the interceptor blades between a first position and a second position. In a preferred form of the invention this means includes a pair of pneumatic cylinders 98 and 100 (FIGS. 1,2 and 5) positioned in stacked, back-to-back relation. The cylinders 98 and 100 are fixedly bolted or otherwise secured together in linearly aligned relation and with the pistons adapted to extend in opposite directions. The lower pneumatic cylinder 100 includes a generally downwardly extending piston 102 having a lower end pivotally joined to the machine frame 38. The upper cylinder 98 includes an upwardly extending piston rod or piston 104 having an upper end pivotally joined to the free end of a lever arm 106, this lever arm, in turn, being fixedly connected to an end of the central shaft 68 in such a manner as to function as a drive crank.

Figure 5:
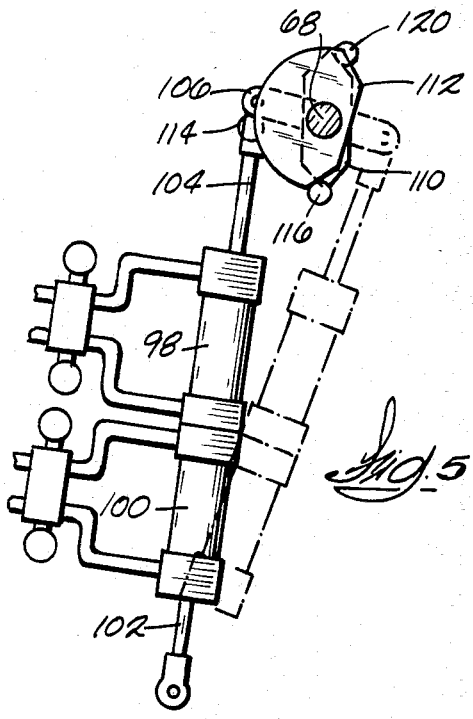
FIG. 5 is a schematic view of the interceptor blade assembly drive means of the newspaper stacker embodied in FIG. 1.

Means are further provided so as to selectively supply air pressure to the pneumatic cylinders 98 and 100 to provide for controlled extension and retraction of the pistons 102 and 104 of those cylinders, thereby causing rotation of the central shaft 68 as illustrated schematically in FIG. 5. This means includes a pair of one pulse double coil valves, one of these valves being operably connected to the upper pneumatic cylinder 98 and the other valve being operably connected to the lower pneumatic cylinder 100 so as to provide for control of extension and retraction of the pistons of those cylinders.

Figure 4:
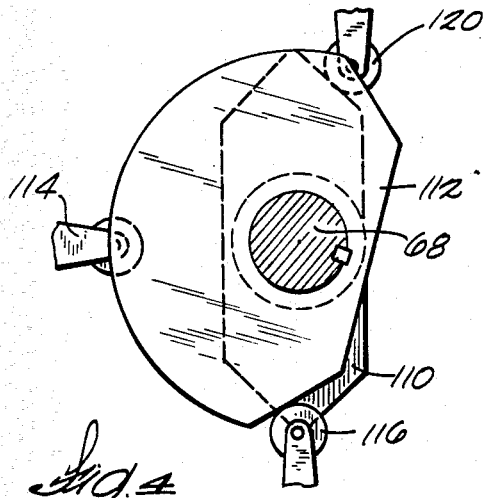
FIG. 4 is a cross section view taken along line 4—4 in FIG. 2.

The means for controlling rotation of the interceptor blades 60 about the longitudinal axis of the central shaft 68 also includes a pair of cams 110 and 112 (FIG. 4) fixed to one end of the central shaft 68 and so as to rotate with the central shaft. A limit switch 114 is fixed to the machine frame 38 and is positioned so as to be engaged by the cam 110. A second limit switch 116 is also fixed to the machine frame 38 and is adapted to be engaged by the other cam 112. As illustrated in FIG. 5, the cam 112 is mounted such that when the lever arm 106 reaches approximately the nine o'clock position, as shown in FIG. 5, the limit switch 116 is in a first position, and the cam 112 is so shaped as to permit the switch 116 to remain in this position until the upper end of the piston rod 104 reaches the three o'clock position as shown in phantom in FIG. 5. The other cam 110 and the associated limit switch 114 are mounted such that the limit switch 114 is in a first position as the upper end of the piston 104 reaches the twelve o'clock position. The configuration of the cam 110 is such that the limit switch 114 is then allowed to move to its second position as soon as the upper end of the piston 104 moves past the twelve o'clock position. Similarly, the cam 110 also causes the limit switch 114 to move to the first position and then to the second position as the upper end of the piston 104 then moves past the six o'clock position.

Referring more particularly to the operation of the means for causing selective indexing rotation of the interceptor blades 60, when the upper end of the piston and rod 104 is at the nine o'clock position, the cam 112 moves past the limit switch 116 and permits that switch to move to a first position, thereby closing a circuit between the timer associated with the counting means and the double coil valve controlling operation of the lower pneumatic cylinder 100. A subsequent signal from the timer associated with the signature counting means then actuates the double coil valve to cause air flow into the lower cylinder 100 in a manner causing extension of the piston 102 of that cylinder. Such extension of the piston 102 will cause the interceptor blade assembly shown in FIG. 5 to rotate from a nine o'clock position toward the twelve o'clock position. As the interceptor blade assembly reaches the twelve o'clock position, the cam 110 engages the limit switch 114 thereby sending a signal to the double coil valve controlling operation of the lower cylinder 100 and thereby causing retraction of the piston 102 of that cylinder. Such retraction causes the interceptor blade assembly to rotate from the twelve o'clock position to the three o'clock position. As the interceptor blade assembly reaches the three o'clock position, the cam 112 contacts limit switch 116 thereby opening the circuit between the counting means timer and the double coil valve operating the lower pneumatic cylinder 100 and closing a circuit between the counting means timer and the solenoid operated valve controlling air flow into the upper pneumatic cylinder 98. Upon receipt of a subsequent signal from the counting means timer, that double coil valve will then cause air flow into the upper cylinder 98 to effect retraction of the piston 104 and thereby causing the interceptor blade assembly to rotate from the three o'clock position to the six o'clock position. As the interceptor blade assembly reaches the six o'clock position, the cam 110 engages the limit switch 114 thereby providing a signal to the double coil valve controlling cylinder 98 and causing air flow into the cylinder 98 to affect extension of the piston 104 and to cause rotation of the interceptor blade assembly from the six o'clock position once again to the nine o'clock position, wherein the cycle described above is repeated.

In reviewing the operation of the apparatus described above, the sequence of operation can be conveniently referred to as commencing with the stacking blades 22 being in the stacking position shown in solid lines in FIG. 1 and with the interceptor blades 60 being in the position shown in solid lines in FIG. 1. As signatures are fed through the infeed section 12, the counting means will count a preselected number of signatures, for example, 25. As the counting means counts the twenty-fifth signature, it sends a signal to the counting means timer. After a delay sufficient to permit that twenty-fifth signature to move past the tips of the interceptor blades 60, the timer sends a signal to the valve operatably connected to cylinder 92 whereupon the interceptor blades 60 will move into the intercept position. The signal from the counting means is also transmitted to a second timer which, after providing for a suitable delay to permit the last or twenty-fifth signature to fall onto the signature stack, relays an electrical signal to the solenoid operated valve operating the pneumatic cylinder 40 whereupon the stacker blades 22 are retracted and drop the bundle of signatures 14 thereon onto the holding bucket assembly 24. As the stacker blades 22 reach their fully retracted position, the limit switch 58 is engaged, thereby activating the pneumatic cylinder 40 so as to cause return of the stacker blades 22 to the bundle forming position. The engaging of limit switch 58 also transmits a signal to the valves controlling rotation of the interceptor blade assembly whereupon the interceptor blade assembly is caused to rotate 180° degrees in the manner described above. When the interceptor blade assembly rotates in a clockwise direction as seen in FIG. 1, the signatures 14 collected on signature blades 60 are dropped onto the stacker blades 22 to commence the stacking operation. Subsequently, the signatures moving through the infeed section 12 will fall directly onto the stacker blades 22. During such rotation of the interceptor blade assembly, the cam 110 engages a limit switch 120, thereby sending a reset signal to the valve controlling operation of the pneumatic cylinder 92. The pneumatic cylinder 92 extends thereby causing the moveable cam track portion 88 to move to a position where it forms a continuous cam path. As the interceptor blade assembly completes its rotation, the moveable cam portion 88 will then be in a position to receive the cam follower 84 of the next pair of interceptor blades 60. In a preferred embodiment of the invention means are also provided for serving as an interlock to prevent the energizing of the valve associated with cylinder 92 until the cam follower 84 is housed in the moveable cam track portion 88. In the illustrated construction this means includes a limit switch 120 (FIGS. 4 and 5) positioned so as to be engaged by the cam 110.

When the interceptor blades have completed their 180° rotation, they are then in position to drop into an intercept position upon receiving a signal from the signature counting means and the associated timer whereupon the piston 96 of the pneumatic cylinder 92 will cause downward movement of the tip of the interceptor blades 60 and the stacking cycle will be repeated.

One of the particular advantages of the apparatus described above is that it provides a relatively uncomplicated mechanism particularly adapted to be trouble free and permitting high speed operation for extended periods of time without maintenance. Such simplified structure is faciliated, in part, by the employment of all pneumatic cylinders to drive the stacker blade mechanisms and the interceptor blade mechanisms. The arrangement described above also permits the use of relatively simplified electronic apparatus and thereby avoids maintenance problems.

Another advantage of the apparatus described above is in the interceptor blade drive assembly including the back-to-back drive cylinders. This structure provides a high speed interceptor blade drive and also provides for positive drive and consistent positioning of the interceptor blades following each indexing step.

A further advantage of the above described apparatus is in the high speed operation which may be achieved. High speed indexing of the interceptor blades and the means for causing the interceptor blades to drop the signatures thereon onto the stacker blades in anticipation of the stacker blades returning to the stacking position are both effective in reducing the period of operation of a cycle to a minimum.

Various features of the invention are set forth in the followings claims.

I claim:

1. A signature stacker for forming bundles containing a preselected number of signatures from an incoming stream of signatures delivered to the stacker, the signature stacker comprising a frame, an infeed conveyor means for receiving the signature stream, a bundle outfeed means, a stacking blade assembly positioned below said infeed conveyor means and for receiving a preselected number of signatures from said infeed conveyor means and for forming a bundle of signatures, said stacking blade assembly being moveable between a stacking position wherein said stacking blade assembly can receive signatures and a retracted position wherein said bundle is dropped onto said bundle outfeed means, and an interceptor blade assembly positioned between said infeed conveyor means and said stacking blade assembly, said interceptor blade assembly including a first blade assembly having a first interceptor blade and a second blade assembly having a second interceptor blade, and said interceptor blade assembly including means for supporting said first blade assembly and said second blade assembly for selective rotational indexing movement around a horizontal axis, one of said blade assemblies being supported on one side of said horizontal axis in a first position and the other of said blade assemblies being supported on an opposite side of said horizontal axis in a second position, and means for causing indexing rotation of said interceptor blade assembly around said horizontal axis in a single rotational direction, said means for causing indexing rotation including a lever arm connected to said interceptor blade assembly and a fluid cylinder assembly including a first fluid cylinder housing a first extensible piston and a second fluid cylinder housing a second extensible piston, said first fluid cylinder and said second fluid cylinder being fixed together in linearly aligned relation, said fluid cylinder assembly being connected to said lever arm to cause indexing rotation of said lever arm around said horizontal axis.

2. A signature stacker as set forth in claim 1, wherein said means for supporting said first and second interceptor blade assemblies includes a central shaft rotatable about said horizontal axis.

3. A signature stacker for forming bundles containing a selected number of signatures from an incoming stream of signatures delivered to the signature stacker, the signature stacker comprising:

a frame, an infeed conveyor means for receiving the signature stream, a bundle outfeed means, a stacking blade assembly positioned below said infeed conveyor means and for receiving a selected number of signatures from said infeed conveyor means and for forming a bundle of signatures, said stacking blade assembly including at least one stacking blade adapted to support the bundle of signatures, and means for supporting said stacking blade for linear reciprocal movement substantially in the plane of the stacking blade between a first position over said bundle outfeed means and wherein said stacking blade supports a signatures thereon and a retracted position wherein said stacking blade drops said bundle onto said bundle outfeed means, means for interrupting the stream of signatures when said stacking blade is moved to said retracted position, and means for interrupting including an interceptor blade selectively moveable from a first position to an intercept position wherein said interceptor blade moves into the path of said stream of signatures so as to support a stack of signatures, and to a retracted position wherein said interceptor blade will drop the signatures supported thereon onto the stacking blade, means for counting a preselected number of signatures passing through said infeed conveyor means and for causing said stacking blades to move from said stacking position to said retracted position and said interceptor blade to move from said first position to said intercept position, means for causing said stacking blades to return to said stacking position as soon as said stacking blades reach said retracted position, and means for causing said stacking interceptor blade to move to said retracted position as soon as said stacking blades approach said stacking position and before said stacking blades reach said stacking position, said means for interrupting the stream of signatures including an interceptor blade assembly positioned between said infeed conveyor means and said stacking blade assembly, said interceptor blade assembly including a first blade assembly having a first interceptor blade and a second blade assembly having a second interceptor blade, each of said first and second interceptor blades having a blade tip, and said interceptor blade assembly including means for supporting said first blade assembly and said second blade assembly for selective rotational indexing movement around a horizontal axis, one of said first blade assemblies being supported on one side of said horizontal axis in a first position and the other of said blade assemblies being supported on an opposite side of said horizontal axis in a retracted position, and means for causing indexing rotation of said interceptor blade assembly around said horizontal axis in a single rotational direction, said means for causing indexing rotation including a lever arm connected to said interceptor blade assembly and a fluid cylinder assembly including a first fluid cylinder housing a first extensible piston and a second fluid cylinder housing a second extensible piston, said first fluid cylinder and said second fluid cylinder being fixed together in linearly aligned relation, said fluid cylinder assembly being connected to said lever arm to cause indexing rotation of said lever arm around said horizontal axis.

4. A signature stacker as set forth in claim 3, wherein said stacking blade assembly further includes a pneumatic cylinder operably connected to said means for supporting said stacking blade and for causing selective movement of said stacking blade between said first position and said retracted position, a limit switch engaged by said means for supporting said stacking blade when said stacking blade reaches said retracted position, and a timer operably connected to said limit switch and connected to said means for intercepting, said timer including means for producing a signal causing said intercept blade to move into the path of said stream of signatures as said stacking blades approach said stacking position.

5. A signature stacker as set forth in claim 3 wherein in said means for supporting said first and second interceptor blade assemblies includes a central shaft rotatable about said horizontal axis.

6. A signature stacker as set forth in claim 5, wherein said means for supporting said first interceptor blade assembly includes first support means fixed to said central shaft for rotation about said horizontal axis and for supporting said first interceptor blade for selective rotation about an axis parallel to said central axis and spaced outwardly from said central axis, and second support means fixed to said horizontal shaft for rotation about said horizontal axis and for supporting said second interceptor blade for selective rotation about a second axis parallel to said central axis and spaced outwardly from said central axis, said axis of said second support means being on an opposite side of said central axis from said axis of said first support means.

7. A signature stacker as set forth in claim 3, wherein said means for supporting said intercept blade assemblies includes a cam track surrounding said central axis, and wherein said first support means includes a first support shaft, a lever having opposite ends, one of said lever opposite ends being fixed to said first support shaft and the other of said opposite ends being connected to a cam follower adapted to move along said cam track in response to rotational indexing movement of said first blade assembly and said second blade assembly around said horizontal axis.

8. Apparatus for causing indexing rotation of a shaft having opposite ends about its longitudinal axis, said indexing rotation being in a single rotational direction, said apparatus for causing indexing rotation comprising a frame, a shaft having a longitudinal axis and being supported by said frame for rotation around said longitudinal axis, a lever arm having opposite ends, one end being fixed to one end of said shaft, and a fluid cylinder assembly including a first fluid cylinder housing a first extensible piston and a second fluid cylinder housing a second extensible piston, said first fluid cylinder and said second fluid cylinder being fixed together in linearly aligned relation, said fluid cylinder assembly having opposite ends, one of said opposite ends being connected to said frame and the other of said opposite ends being pivotally connected to the other of said opposite ends of said lever arm.

9. Apparatus for causing indexing rotation of a shaft as set forth in claim 8, wherein first fluid cylinder and said second fluid cylinder are fixedly joined together in end-to-end abutting relation, and said first extensible piston and said second extensible piston are extensible in opposite directions.

10. Apparatus for causing indexing rotation of a shaft as set forth in claim 9 and further including means for controlling extension and retraction of said first extensible piston and said second extensible piston to thereby cause rotation of said shaft from a first index position to a second index position, said shaft being in a first index position when one of said first extensible piston and said second extensible piston is extended and the other of said first extensible piston and said second extensible piston is retracted, and wherein said means for causing said shaft to rotate from said first index position to a second index position includes means for causing extension of the other of said first extensible piston and said second extensible piston and then retraction of the other of said first extensible piston and said second extensible piston, and wherein said means for causing said shaft to rotate from said second index position to said first index position includes means for causing retraction of said one of said first extensible piston and said second extensible piston and then extension of said one of said first extensible piston and said second extensible piston.

11. A signature stacker for forming bundles containing a preselected number of signatures from an incoming stream of signatures delivered to the stacker, the signature stacker comprising a frame, an infeed conveyor means for receiving the signature stream, a bundle outfeed means, a stacking blade assembly positioned below said infeed conveyor means and for receiving a preselected number of signatures from said infeed conveyor means and for forming a bundle of signatures, said stacking blade assembly being moveable between a stacking position wherein said stacking blade assembly can receive signatures and a retracted position wherein said bundle is dropped onto said bundle outfeed means, and an interceptor blade assembly positioned between said infeed conveyor means and said stacking blade assembly, said interceptor blade assembly including a first blade assembly having a first interceptor blade and a second blade assembly having a second interceptor blade, and said interceptor blade assembly including means for supporting said first blade assembly and said second blade assembly for selective rotational indexing movement around a horizontal axis, one of said blade assemblies being supported on one side of said horizontal axis in a first position and the other of said blade assemblies being supported on an opposite side of said horizontal axis in a retracted position, said means for supporting said first and second interceptor blade assemblies including a central shaft rotatable about said horizontal axis, a first support means fixed to said central shaft for rotation about said horizontal axis and for supporting said first interceptor blade for selective rotation about an axis parallel to said central axis and spaced outwardly from said central axis, and second support means fixed to said horizontal shaft for rotation about said horizontal axis and for supporting said second interceptor blade for selective rotation about a second axis parallel to said central axis and spaced outwardly from said central axis, said axis of said second support means being on an opposite side of said central axis from said axis of said first support means.

12. A signature stacker as set forth in claim 11, wherein said means for supporting said interceptor blade assemblies includes a cam track surrounding said central axis, and wherein said first support means includes a first support shaft, a lever having opposite ends, one of said lever opposite ends being fixed to said first support shaft and the other of said opposite ends being connected to a cam follower adapted to move along said cam track in response to rotational indexing movement of said first blade assembly and said second blade assembly around said horizontal axis.

13. A signature stacker for forming bundles containing a preselected number of signatures from an incoming stream of signatures delivered to the stacker, the signature stacker comprising a frame, an infeed conveyor means for receiving the signature stream, a bundle outfeed means, a stacking blade assembly positioned below said infeed conveyor means and for receiving a preselected number of signatures from said infeed conveyor means and for forming a bundle of signatures, said stacking blade assembly being moveable between a stacking position wherein said stacking blade assembly can receive signatures and a retracted position wherein said bundle is dropped onto said bundle outfeed means, and an interceptor blade assembly positioned between said infeed conveyor means and said stacking blade assembly, said interceptor blade assembly including a first blade assembly having a first interceptor blade and a second blade assembly having a second interceptor blade, and said interceptor blade assembly including means for supporting said first blade assembly and said second blade assembly for selective rotational indexing movement around a horizontal axis, one of said blade assemblies being supported on one side of said horizontal axis in a first position and the other of said blade assemblies being supported on an opposite side of said horizontal axis in a retracted position, and said intercpetor blade assembly including a central shaft having opposite ends and supporting said first interceptor blade assembly and said second interceptor blade assembly, and means for causing indexing rotation of said central shaft about said axis, said means for causing indexing rotation including a lever arm having opposite ends, one end being fixed to one of said opposite ends of said central shaft, and a fluid cylinder assembly including a first fluid cylinder and a second fluid cylinder fixed together in linearly aligned relation, said fluid cylinder assembly having opposite ends, one of said opposite ends being connected to said frame and the other of said opposite ends being connected to the other of said opposite ends of said lever arm.

14. A signature stacker as set forth in claim 13 wherein said first fluid cylinder includes a first cylinder and a first extensible piston, and said second fluid cylinder includes a second cylinder and a second extensible piston, said first cylinder and said second cylinder being fixedly joined together in end-to-end abutting relation, and said pistons being extensionable in opposite directions.

15. A signature stacker as set forth in claim 14 and further including means for contolling extension and retraction of said pistons to thereby cause indexing of said central shaft from a first rotational position to a second rotational position, said intercaptor blade assembly being in a first index position when one of said pistons is extended and the other of said pistons is retracted, and wherein said means for causing said central shaft to rotate from said first index position to a second index position includes means for causing extension of the other of said pistons and then retraction of the other of said pistons, and wherein said means for causing said central shaft to rotate from said second index position to said first index position includes means for causing retraction of said one of said pistons and then extension of said one of said pistons.

16. A signature stacker for forming bundles containing a selected number of signatures from an incoming stream of signatures delivered to the signature stacker, the signature stacker comprising:

a frame, an infeed conveyor means for receiving the signature stream, a bundle outfeed means, a stacking blade assembly positioned below said infeed conveyor means and for receiving a selected number of signatures from said infeed conveyor means and for forming a bundle of signatures, said stacking blade assembly including at least one stacking blade adapted to support the bundle of signatures, and means for supporting said stacking blade for movement from a first position over said bundle outfeed means and wherein said stacking blade supports signatures thereon and a retracted position wherein said stacking blade drops said bundle onto said bundle outfeed means, means for interrupting the stream of signatures when said stacking blade is moved to said retracted position, said means for interrupting including an interceptor blade selectively moveable from a first position, to an intercept position wherein said interceptor blade moves into the path of said stream of sigantures so as to support a stack of signatures, and to a retracted position wherein said interceptor blade will drop the signatures supported threon onto said stacking blade, means for counting a preselected number of signatures passing through said infeed conveyor means and for causing said stacking blades to move from said stacking position to said retracted position and said intercept blades to move from said first position to said intercept position, means for causing said stacking blades to return to said stacking position as soon as said stacking blades reach said retracted position, and means for causing said intercept blades to move to said retracted position as soon as said stacking blades approach said stacking position and before said stacking blades reach said stacking position, and said stacking blade assembly further including a pneumatic cylinder operably connected to said means for supporting said stacking blade and for causing selective movement of said stacking blade between said first position and said retracted position, a limit switch engaged by said means for supporting said stacking blade when said stacking blade reaches said retracted position, and a timer operably connected to said limit switch and connected to said means for intercepting, said timer including means for producing a signal causing said intercept blade to move into the path of said stream of signatures as said stacking blades approach said stacking position.

17. A signature stacker for forming bundles containing a selected number of signatures from an incoming stream of signatures delivered to the signature stacker, the signature stacker comprising:

a frame, an infeed conveyor means for receiving the signature stream, a bundle outfeed means, a stacking blade assembly positioned below said infeed conveyor means and for receiving a selected number of signatures from said infeed conveyor means and for forming a bundle of signatures, said stacking blade assembly including at least one stacking blade adapted to support the bundle of signatures, and means for supporting said stacking blade for movement from a first position over said bundle outfeed means and wherein said stacking blade supports signatures thereon and a retracted position wherein said stacking blade drops said bundle onto said bundle outfeed means, means for interrupting the stream of signatures when said stacking blade is moved to said retracted position, said means for interrupting including an interceptor blade selectively moveable from a first position, to an intercept position wherein said interceptor blade moves into the path of said stream of signatures so as to support a stack of signatures, and to a retracted position wherein said interceptor blade will drop the signatures supported thereon onto said stacking blade, means for counting a preselected number of signatures passing through said infeed conveyor means and for causing said stacking blade to move from said stacking position to said retracted position and said interceptor blade to move from said first position to said intercept position, means for causing said stacking blade to return to said stacking position as soon as said stacking blade reaches said retracted position, and means for causing said interceptor blade to move to said retracted position as soon as said stacking blade approaches said stacking position and before said stacking blade reaches said stacking position, and said means for interrupting the stream of signatures including an interceptor blade assembly positioned between said infeed conveyor means and said stacking blade assembly, said interceptor blade assembly including a first blade assembly having a first interceptor blade and a second blade assembly having a second interceptor blade, each of said interceptor blades having a blade tip, and said interceptor blade assembly including means for supporting said first blade assembly and said second blade assembly for selective rotational indexing movement around a horizontal axis, one of said blade assemblies being supported on one side of said horizontal axis in a first position and, the other of said blade assemblies being supported on an opposite side of said horizontal axis in a retracted position.

18. A signatures stacker as set forth in claim 17 wherein said means for supporting said first and second blade assemblies includes a central shaft rotatable about said horizontal axis.

19. A signature stacker as set forth in claim 18, wherein said means for supporting said first blade assembly includes first support means fixed to said central shaft for rotation about said horizontal axis and for supporting said first interceptor blade for selective rotation about an axis parallel to said central axis and spaced otuwardly from said central axis, and second support means fixed to said horizontal shaft for rotation about said horizontal axis and for supporting said second interceptor blade for selective rotation about a second axis parallel to said central axis and spaced outwardly from said central axis, said axis of said second support means being on an opposite side of said central axis from said axis of said first support means.

20. A siganture stacker as set forth in claim 19, wherein said means for supporting said blade assemblies includes a cam track surrounding said central axis, and wherein said first support means includes a first support shaft, a lever having opposite ends, one of said lever opposite ends being fixed to said first support shaft and the other of said opposite ends being connected to a cam follower adapted to move along said cam track in response to rotational indexing movement of said first blade assembly and said second blade assembly around said horizontal axis.

21. A signature stacker as set forth in claim 17 wherein said interceptor blade assembly includes a central shaft having opposite ends and supporting said first blade assembly and said second blade assembly, and means for causing indexing rotation of said central shaft about said axis, said means for causing indexing rotation including a lever arm having opposite ends, one end being fixed to one of said opposite ends of said central shaft, and a fluid cylinder assembly including a first fluid cylinder and a second fluid cylinder fixed together in a linearly aligned relation, said fluid cylinder assembly having opposite ends, one of said opposite ends being connected to said frame and the other of said opposite ends being connected to the other of said opposite ends of said lever arm.

22. A signature stacker as set forth in claim 21, wherein said first fluid cylinder includes a first cylinder and a first extensible piston, and said second fluid cylinder includes a second cylinder and a second extensible piston, said first cylinder and said second cylinder being fixedly joined together in end-to-end abutting relation, and said pistons being extensible in opposite directions.

23. A signature stacker as set forth in claim 22 and further including means for controlling extension and retraction of said pistons to thereby cause indexing of said control shaft from a first rotational position to a second rotational position, said interceptor blade assembly being in a first index position when one of said pistons is extended and the other of said pistons is retracted, and wherein said means for causing said central shaft to rotate from said first index position to a second index position includes means for causing extension of the other of said pistons and then retraction of the other of said pistons, and wherein said means for causing said central shaft to rotate from said second index position to said first index position includes means for causing retraction of said one of said pistons and then extension of said one of said pistons.

* * * * *